US010871029B2

(12) United States Patent
Ter Haar et al.

(10) Patent No.: US 10,871,029 B2
(45) Date of Patent: Dec. 22, 2020

(54) SCREEN WITH HEAD RAIL, BOTTOM RAIL AND MIDDLE RAIL AND A FIRST CONTROL UNIT FOR THE MIDDLE RAIL AND A SECOND CONTROL UNIT FOR THE BOTTOM RAIL

(71) Applicant: Coulisse B.V., Enter (NL)

(72) Inventors: Thomas Johan Maria Ter Haar, Hengelo (NL); Bastiaan Franciscus Klein Tuente, Groenlo (NL); Harry Davids, Utrecht (NL)

(73) Assignee: Coulisse B.V., Enter (NL)

( * ) Notice: Subject to any disclaimer, the term of this patent is extended or adjusted under 35 U.S.C. 154(b) by 268 days.

(21) Appl. No.: 16/043,240

(22) Filed: Jul. 24, 2018

(65) Prior Publication Data

US 2019/0032402 A1 Jan. 31, 2019

(30) Foreign Application Priority Data

Jul. 25, 2017 (NL) ..... 2019347
Feb. 22, 2018 (NL) ..... 2020475

(51) Int. Cl.
*E06B 9/322* (2006.01)
*E06B 9/262* (2006.01)
(Continued)

(52) U.S. Cl.
CPC ..... *E06B 9/322* (2013.01); *E06B 9/262* (2013.01); *E06B 9/325* (2013.01);
(Continued)

(58) Field of Classification Search
CPC ..... E06B 9/322; E06B 9/262; E06B 9/325; E06B 9/88; E06B 2009/2423;
(Continued)

(56) References Cited

U.S. PATENT DOCUMENTS 5,121,783 A * 6/1992 Nilsson ..... E06B 9/262 160/115
7,520,311 B2 * 4/2009 Drew ..... E06B 9/322 160/171

(Continued)

FOREIGN PATENT DOCUMENTS

EP 2305943 A2 4/2011
WO 2011137205 A1 11/2011

OTHER PUBLICATIONS

European Search Report in application EP18184526, completed Nov. 9, 2018.

*Primary Examiner* — Johnnie A. Shablack
(74) *Attorney, Agent, or Firm* — Oppedahl Patent Law Firm LLC

(57) ABSTRACT

The invention relates to a screen, comprising a first control unit (610) comprising a first drive shaft (612) and at least one first cord spool (630) rotatable with the first drive shaft for winding and unwinding a first lift cord (634) extending between a head rail and a middle rail;
a second control unit (620) comprising a second drive shaft (622), and at least one second cord spool (632) rotatable with the second drive shaft for winding and unwinding a second lift cord (636) extending between the head rail and the bottom rail;
and a shaft rotation limiting system (100) comprising a threaded shaft arranged on and rotatable in unison with one of the first and the second drive shafts, a coupling element threaded on said threaded shaft, wherein the coupling element is associated with and rotatable in unison with the other drive shaft.

10 Claims, 7 Drawing Sheets

(51) Int. Cl.
*E06B 9/325* (2006.01)
*E06B 9/24* (2006.01)

(52) U.S. Cl.
CPC ..... *E06B 2009/2423* (2013.01); *E06B 2009/2441* (2013.01); *E06B 2009/2625* (2013.01); *E06B 2009/2627* (2013.01)

(58) Field of Classification Search
CPC ..... E06B 2009/2441; E06B 2009/2625; E06B 2009/2627
See application file for complete search history.

(56) References Cited

U.S. PATENT DOCUMENTS 7,740,045 B2 * 6/2010 Anderson ..... E06B 9/322 160/84.05
7,857,033 B2 * 12/2010 Malausa ..... E06B 9/88 160/295
7,886,803 B2 * 2/2011 Anderson ..... E06B 9/262 160/170
8,365,797 B2 * 2/2013 Drew ..... E06B 9/262 160/84.05
8,573,281 B2 * 11/2013 Drew ..... E06B 9/262 160/173 R
8,720,523 B2 * 5/2014 Nakamura ..... E06B 9/262 160/84.03
8,752,607 B2 * 6/2014 Anderson ..... E06B 9/262 160/84.05
8,830,058 B2 * 9/2014 Yeh ..... A47H 5/0325 160/310
9,004,139 B2 * 4/2015 Wu ..... E06B 9/262 160/167 R
9,695,633 B2 * 7/2017 Morris ..... E06B 9/262
9,732,555 B2 * 8/2017 Morris ..... E06B 9/322
9,752,380 B2 * 9/2017 Anderson ..... E06B 9/262
9,765,565 B2 * 9/2017 Morris ..... E06B 9/262
9,797,188 B2 * 10/2017 Rettig ..... E06B 9/266
9,988,838 B2 * 6/2018 Chen ..... E06B 9/323
10,344,528 B2 * 7/2019 Anderson ..... E06B 9/322
10,451,145 B2 * 10/2019 Chen ..... F16F 9/125
2003/0226644 A1 * 12/2003 Koot ..... E06B 9/32 160/84.02
2006/0048904 A1 * 3/2006 Gruner ..... E06B 9/262 160/84.05
2008/0216967 A1 * 9/2008 Liang ..... E06B 9/326 160/168.1 V
2009/0014133 A1 * 1/2009 Lin ..... E06B 9/262 160/181
2011/0005690 A1 * 1/2011 Harding ..... E06B 9/262 160/84.03
2011/0265962 A1 11/2011 Drew
2012/0267060 A1 * 10/2012 Anderson ..... E06B 9/262 160/241
2013/0056162 A1 * 3/2013 Aoki ..... E06B 9/262 160/87
2013/0087296 A1 * 4/2013 Mullet ..... E06B 9/262 160/340
2014/0014279 A1 * 1/2014 Defenbaugh ..... E06B 9/68 160/168.1 P
2014/0166216 A1 * 6/2014 Hsu ..... E06B 9/262 160/84.03
2015/0144275 A1 * 5/2015 Ganzi ..... E06B 9/32 160/84.03
2016/0053534 A1 * 2/2016 Chang ..... E06B 9/304 160/168.1 P
2016/0130867 A1 * 5/2016 Cheng ..... E06B 9/262 160/181
2016/0222721 A1 * 8/2016 Rettig ..... E06B 9/262
2016/0222723 A1 * 8/2016 Morris ..... E06B 9/322
2016/0222724 A1 * 8/2016 Morris ..... E06B 9/30
2016/0222725 A1 * 8/2016 Morris ..... E06B 9/262
2017/0081912 A1 * 3/2017 Guillory ..... E06B 9/304
2018/0080279 A1 * 3/2018 Eubanks, Sr. ..... H02S 20/30
2018/0171703 A1 * 6/2018 Buccola, Jr. ..... E06B 9/42
2019/0032402 A1 * 1/2019 Ter Haar ..... E06B 9/262
2019/0178029 A1 * 6/2019 Anderson ..... E06B 9/30
2019/0368267 A1 * 12/2019 Anderson ..... E06B 9/262
2019/0368268 A1 * 12/2019 Church ..... E06B 9/24

* cited by examiner

SCREEN WITH HEAD RAIL, BOTTOM RAIL AND MIDDLE RAIL AND A FIRST CONTROL UNIT FOR THE MIDDLE RAIL AND A SECOND CONTROL UNIT FOR THE BOTTOM RAIL

The present invention relates to a screen, such as a window covering comprising a headrail, a bottom rail movable with respect to the head rail; a middle rail arranged movably between the head rail and the bottom rail and at least one collapsible screen material supported by the middle rail and the bottom rail.

A screen according to the preamble is known in the art and is provided with a first control unit for operating the middle rail and a second control unit for operating the bottom rail. Examples of such a known screen with two control units include a Top Down/Bottom Up System or a Day Night System.

According to the invention the first control unit comprises a first drive shaft, first control means for rotating said first drive shaft, at least one first winding element rotatable with the first drive shaft for winding and unwinding a first lift cord extending between the head rail and the middle rail and the second control unit comprises a second drive shaft, second control means for rotating said second drive shaft and at least one second winding element rotatable with the second drive shaft for winding and unwinding a second lift cord extending between the head rail and the bottom rail through the middle rail and the screen material.

In the known screen the middle rail and the bottom rail move in the same plane. During operation of the first control unit for lowering the middle rail, the bottom rail is hanging still at a random position in the same plane and the middle rail will abut, but cannot pass the bottom rail. Vice versa during operation of the second control unit for raising the bottom rail the middle rail is hanging still at a random position in the same plane. In the latter situation the moving bottom rail can drag the stationary middle rail along. In both situations, the cords of the middle rail will lose their tension and can become entangled resulting in knots. Consequently, the screen will no longer function properly.

The invention has for its object to prevent the above disadvantages.

For this purpose the screen according to the invention is provided with a shaft rotation limiting system comprising a threaded shaft arranged on and rotatable in unison with one of the first and the second drive shafts and a coupling element threaded on said threaded shaft, wherein the coupling element is associated with and rotatable in unison with the other drive shaft.

The coupling element of the shaft rotation limiting system continuously couples the first drive shaft and the second drive shaft and effectively maintains a minimum distance between the middle rail and the bottom rail to prevent loss of tension in the lift cords. Advantageously the shaft rotation limiting system according to the invention is suitable for coupling drive shafts in different configurations, such as parallel drive shafts or drive shafts lying in line.

EP2305943 discloses a shaft rotation limiting system according to the preamble of claim 1 with drive shafts lying in line.

According to the present invention the shaft rotation limiting system further comprises a toothed shaft arranged on and rotatable in unison with the other drive shaft, wherein the coupling element is a toothed nut that is in continuous engagement with the toothed shaft. The shaft rotation limiting system according to the invention continuously couples parallel oriented first and second drive shafts.

According to a first preferred embodiment the toothed nut takes up a predetermined catch position on the threaded shaft and the toothed nut moves out of the catch position upon rotation of either the first shaft or the second shaft and the toothed nut moves towards the catch position upon rotation of the other (second or first) shaft. The toothed nut takes up the catch position every time the middle rail and the bottom rail meet at the minimum distance. This can be anywhere in the plane of the screen.

In a practical elaboration of the first preferred embodiment the first drive shaft and the second drive shaft rotate in opposite directions for moving the middle rail and the bottom rail in the same direction, thereby facilitating the toothed nut moving out of and into the catch position.

In an elegant preferred embodiment the toothed nut is translatable along the toothed shaft upon rotation of the threaded shaft.

In another elegant preferred embodiment the toothed nut is rotatable along the threaded shaft upon rotation of the toothed shaft.

In another preferred embodiment the screen according to the invention comprises a housing, wherein the shaft rotation limiting system is accommodated. The housing allows for easy mounting of the shaft rotation limiting system in the headrail of a screen.

In yet another preferred embodiment the threaded shaft and the toothed nut are provided with cooperating first arresting means defining the predetermined catch position.

In a further preferred embodiment at least one additional collapsible screen material is supported by the middle rail and the head rail.

In a preferred embodiment that is optimized for home automation the first and/or the second control means are motorized.

The invention will now be described in more detail with reference to the figures, in which.

Figure 2:
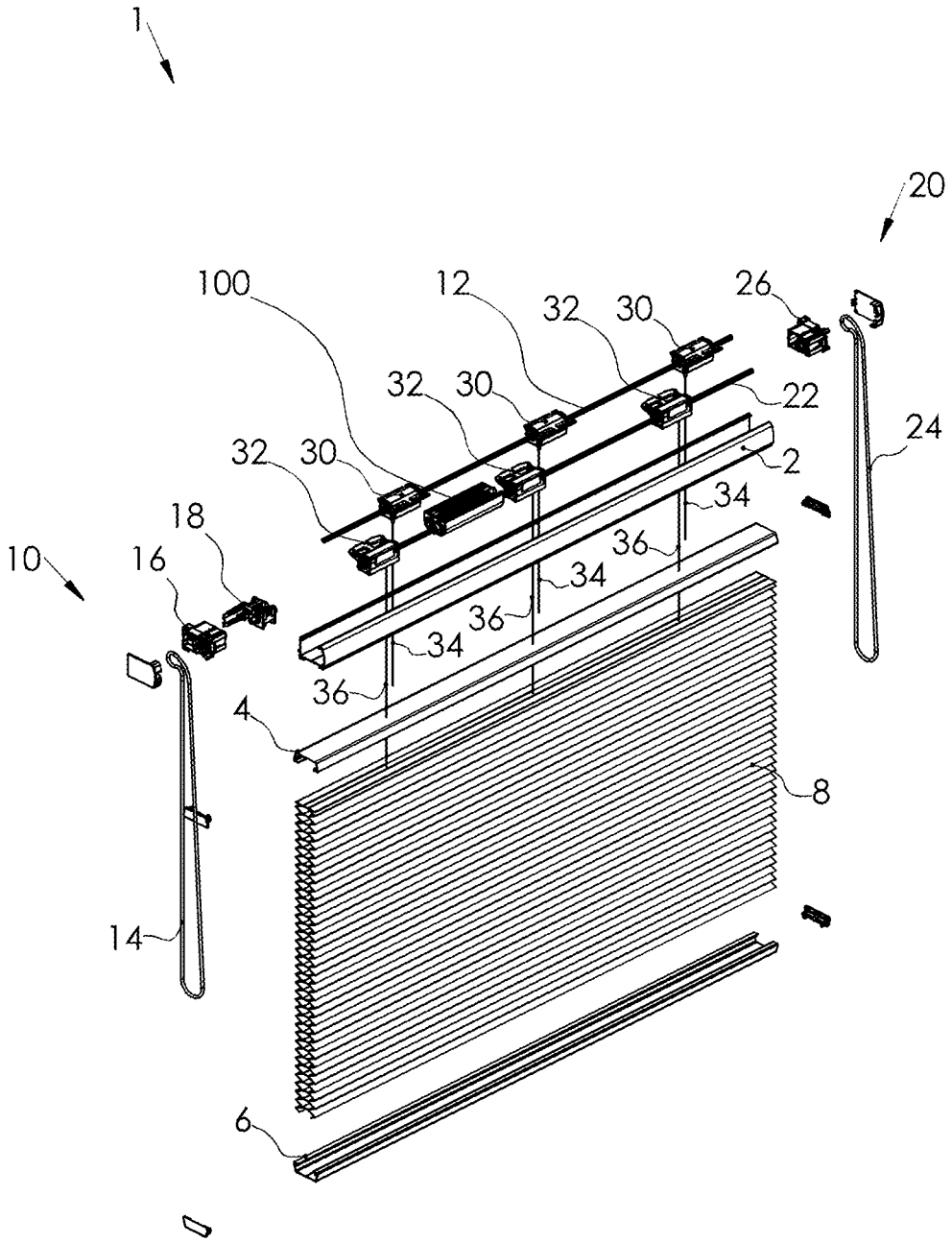
FIG. 2 shows the screen of FIG. 1 with exploded parts.
Figure 3A:
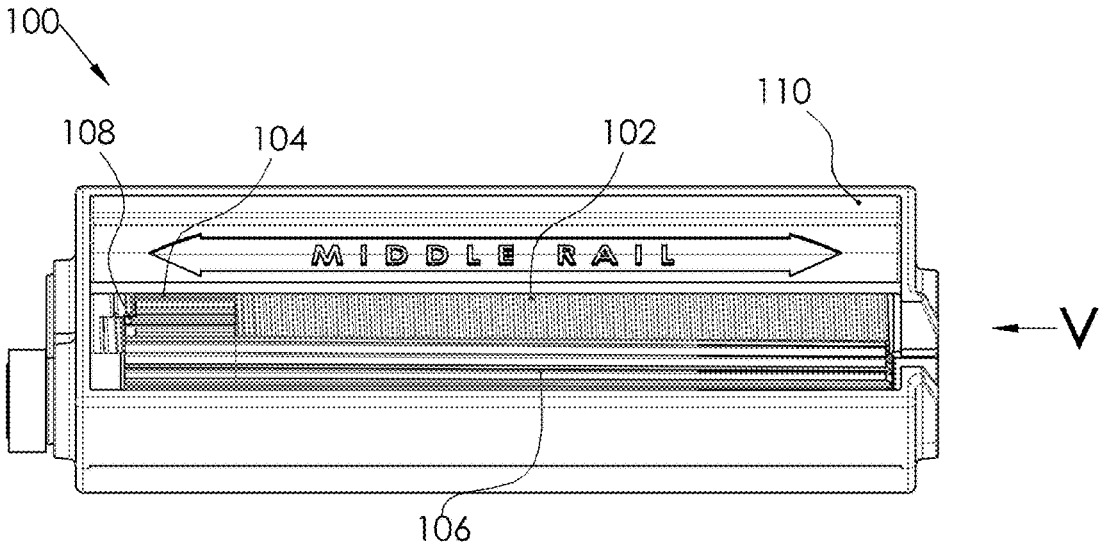
Figure 3B:
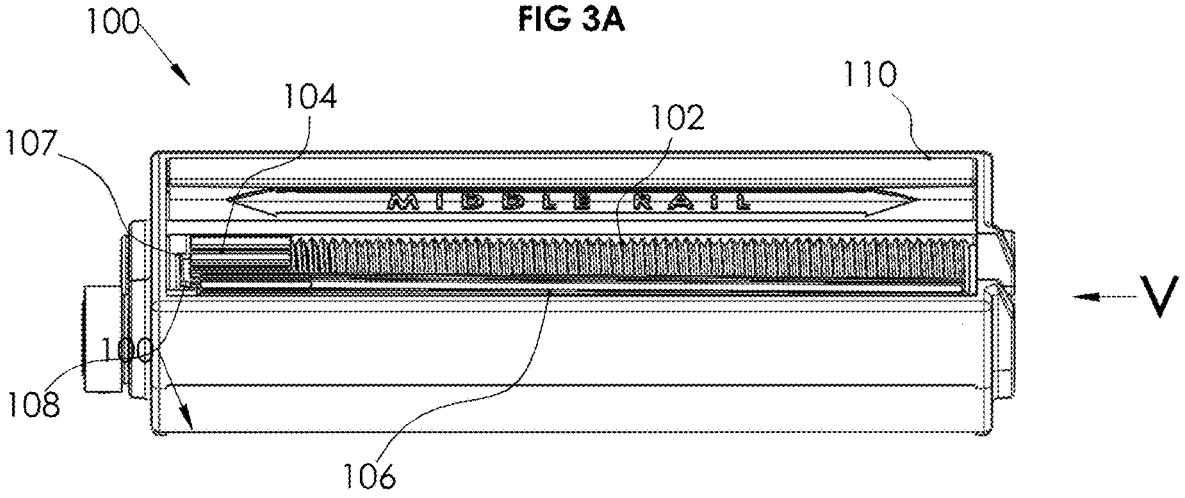
Figure 3C:
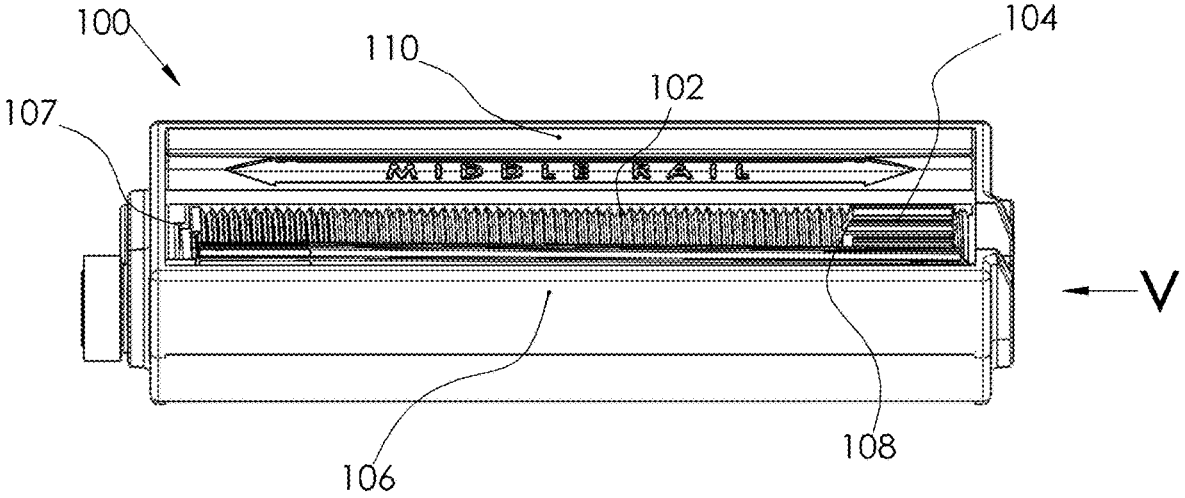
Figure 5:
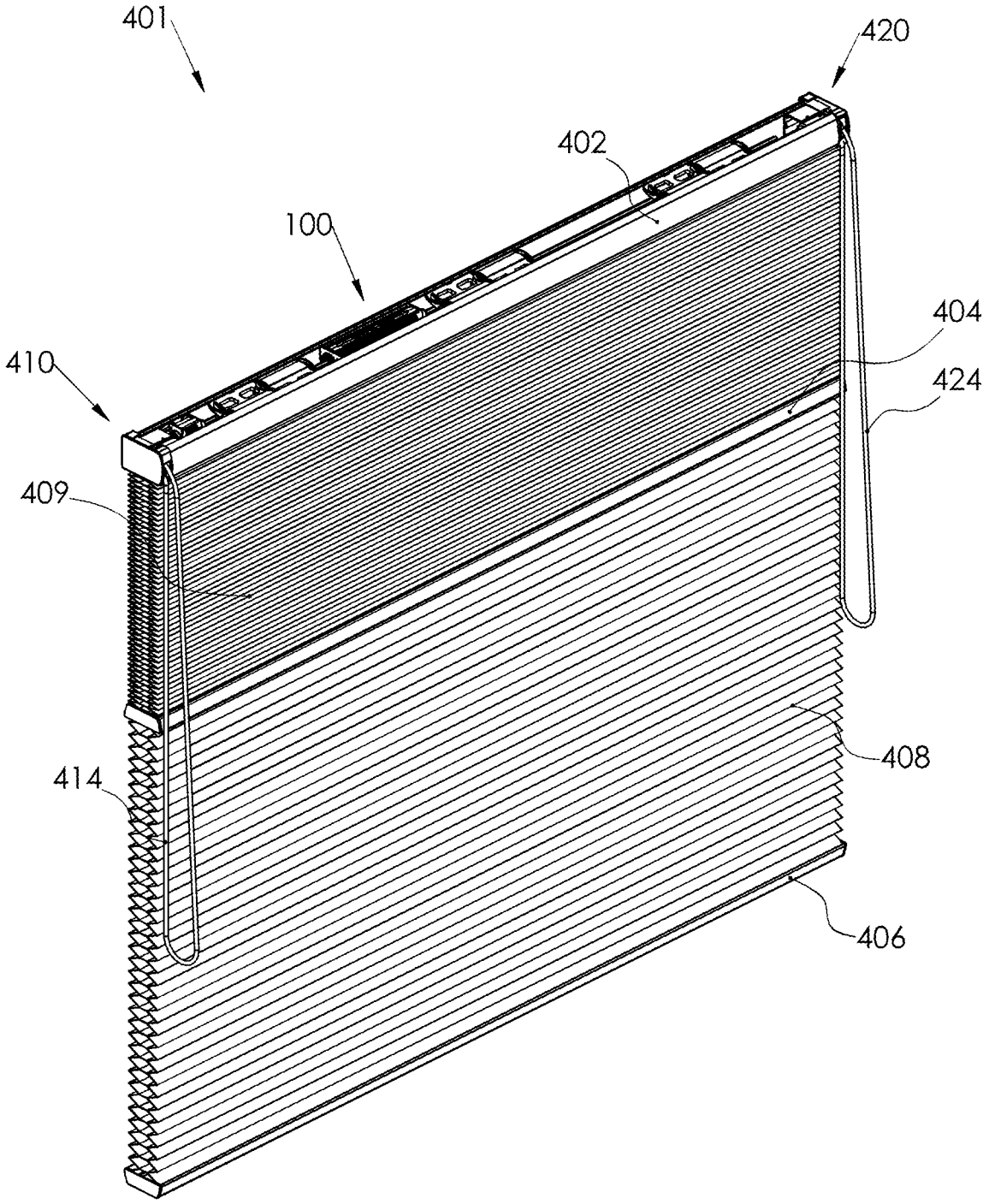
Figure 6:
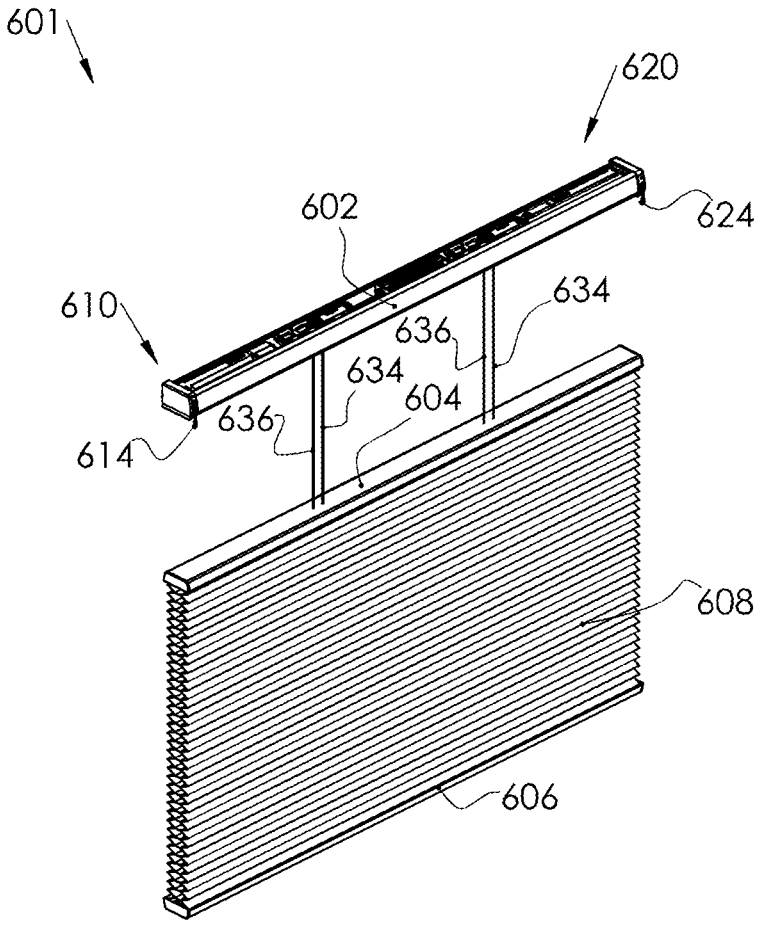
Figure 7:
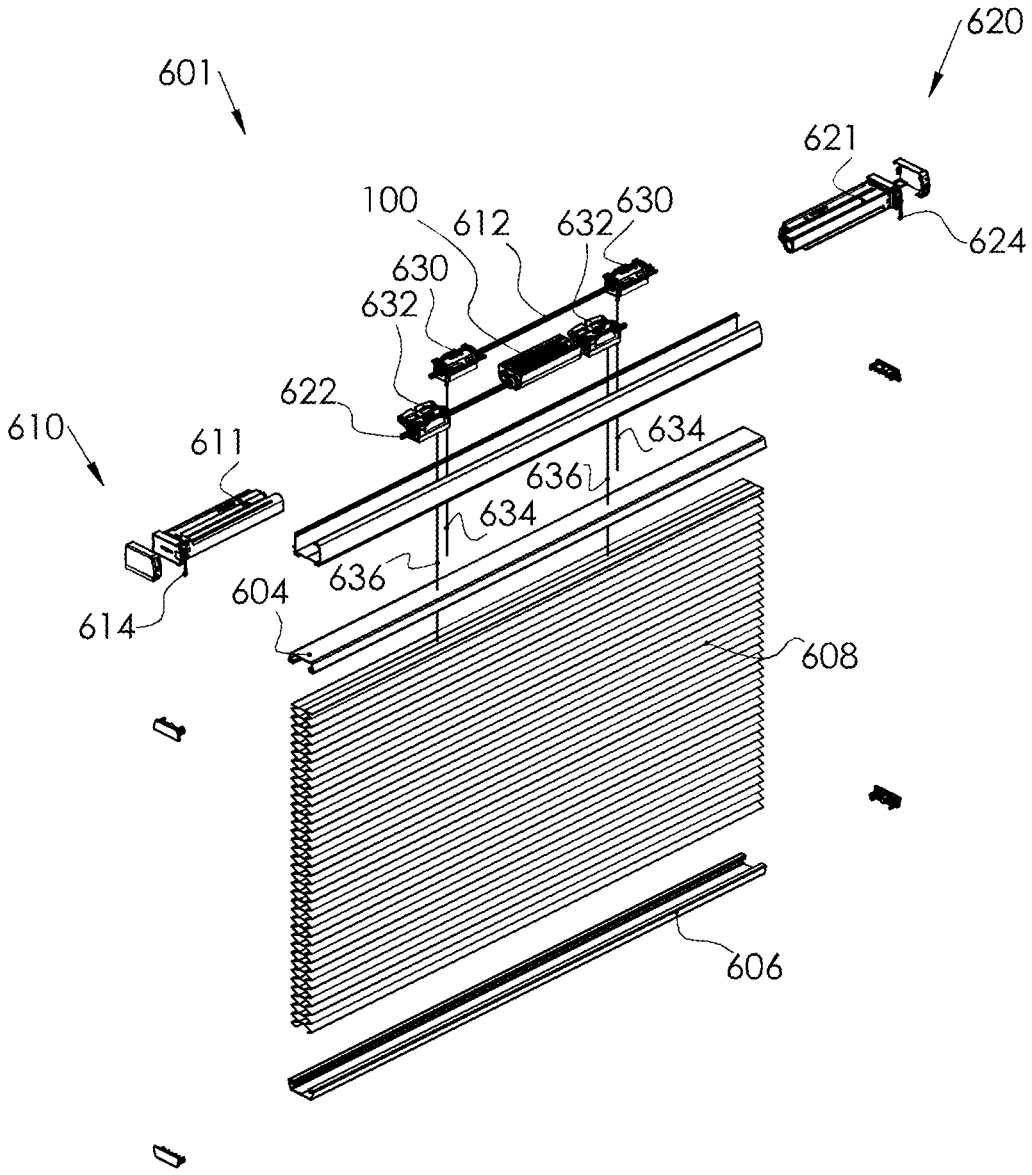

FIG. 3A schematically shows part of FIG. 2 in more detail in a catch position;

FIG. 3B schematically shows the part of FIG. 2 in more detail in a position slightly out of the catch position;

FIG. 3C schematically shows the part of FIG. 2 in more detail in an end position;

FIGS. 4A-D are cross sections through the part of FIGS. 3A-3C;

FIG. 5 shows a schematic view of a second preferred embodiment of a screen according to the invention;

FIG. 6 shows a schematic view of a third preferred embodiment of a screen according to the invention; and FIG. 7 shows the screen of FIG. 6 with exploded parts.

The same components are designated in the different figures with the same reference numerals.

Figure 1:
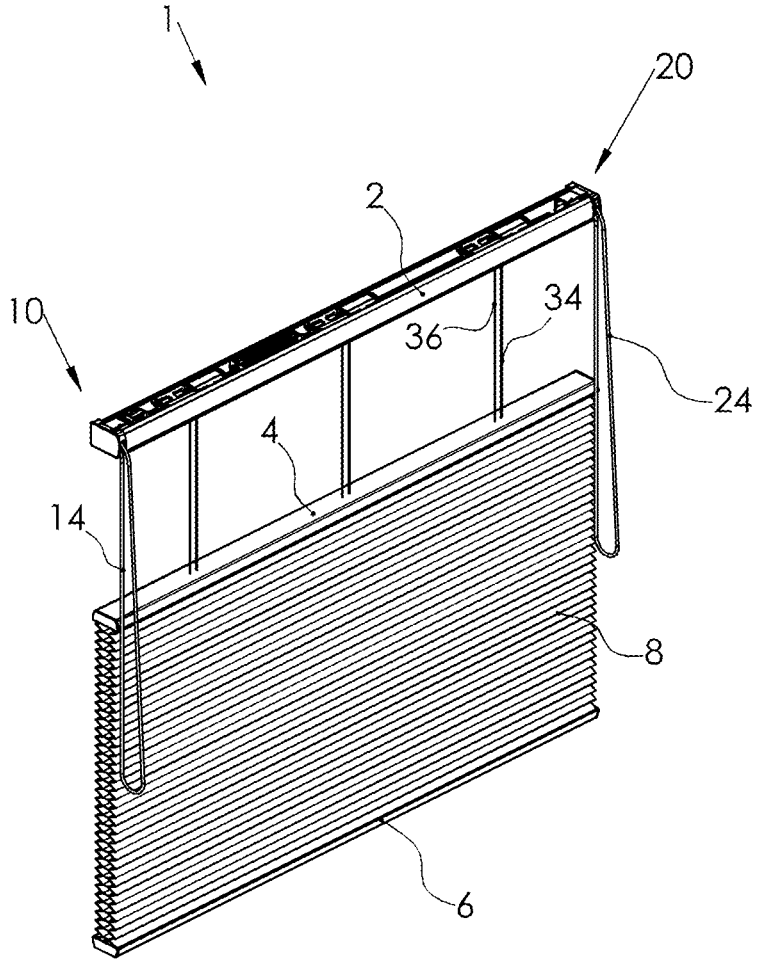
FIG. 1 shows a schematic view of a first preferred embodiment of a screen according to the invention.

FIG. 1 shows a schematic view of a first preferred embodiment of a screen 1 according to the invention. The screen 1 is a window covering, more specifically a top down, bottom up honey cell blind.

The window covering 1 comprises a headrail 2 and a bottom rail 6 that is movable with respect to the head rail. A middle rail 4 is arranged movably between the head rail and the bottom rail. The screen has at least one collapsible screen material 8 that extends between the middle rail 4 and the bottom rail 6.

FIG. 2 shows the screen 1 with exploded parts. A first control unit 10 controls the middle rail and comprises a first drive shaft 12 extending in the head rail 2. First control means for rotating said first drive shaft 12 comprise a chain or cord 14, a gear 16 and a transmission 18. One or more first cord spools 30 are arranged on the first drive shaft 12 for winding and unwinding one or more first lift cords 34 extending from the head rail 2 to the middle rail 4.

A second control unit 20 controls the bottom rail 6 and comprises a second drive shaft 22 extending in the head rail 2 parallel to the first drive shaft 12. Second control means for rotating said second drive shaft 22 comprise a chain or cord 24 and a gear 26. One or more second cord spools 32 are arranged on the second drive shaft 22 for winding and unwinding one or more second lift cords 36 extending between the head rail 2 and the bottom rail 6 through the middle rail 4 and the screen material 8.

The number of cord spools 30 respectively 32 and corresponding lift cords 34 respectively 36 on each drive shaft 12 respectively 22 may vary depending on the size of the screen. In the first preferred embodiment the number is three. One example of a suitable cord spool is described in the European patent EP2589743 of the same applicant.

According to the invention a shaft rotation limiting system is provided. A first preferred embodiment of the shaft rotation limiting system 100 is shown in FIGS. 3A-3C in more detail. A second preferred embodiment of the shaft rotation limiting system 300 is shown in FIG. 7A-7E in more detail.

In general, the shaft rotation limiting system 100 respectively 300 comprises a threaded shaft 102 respectively 302 that is arranged on and rotatable in unison with either the first or the second drive shaft 12 or 22 respectively 312 or 322. A coupling element is threaded on said threaded shaft 102 respectively 302 and is associated with and rotatable in unison with the other drive shaft 22 or 12 respectively 322 or 312.

In the first preferred embodiment shown in FIGS. 3A-3C the threaded shaft 102 is arranged on and rotatable in unison with the first drive shaft 12. The shaft rotation limiting system 100 further comprises a toothed shaft 106 that is arranged on and rotatable in unison with the second drive shaft 22.

The coupling element comprises a toothed nut 104 that is threaded on the threaded shaft 102 and is in continuous engagement with the toothed shaft 106. The threaded shaft 102 has an outer screw thread and the nut 104 has an inner screw thread. The outer screw thread and the inner screw thread fit together.

The toothed shaft 106 is an elongated gear wheel or sprocket wheel and can be compared to many gear wheels or sprocket wheels arranged in line. Preferably the cross section through the toothed shaft 106 is substantially uniform over the entire length of the toothed shaft 106. The toothed nut 104 and the toothed shaft 106 have a mating toothing, i.e. with the same modulus. Preferably the toothing is straight.

The operation of the shaft rotation limiting system 100 will be elucidated referring to FIGS. 4A-D that show cross sections through the shaft rotation limiting system 100 at the position of the nut 104 as seen in the direction of view V. The position of the toothed nut 104 in FIG. 3A is referred to as the catch position. In FIG. 3B the toothed nut 104 has just left the catch position of FIG. 3A. The position in FIG. 3C is referred to as the end position.

Figure 4A:
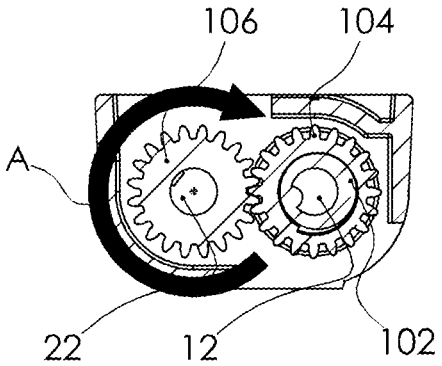

In FIG. 4A the second control means are operated to lower the bottom rail 6. The second drive shaft 22 is rotated clockwise as indicated by the arrow A. Consequently, the toothed shaft 106 rotates in the same direction (clockwise). Because of the continuous engagement with the toothed shaft the toothed nut 104 thereby is rotated along the threaded shaft 102 and leaves the predetermined catch position of FIG. 3A.

Figure 4B:
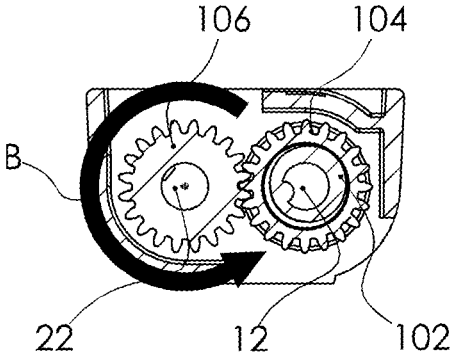

In FIG. 4B the second control means are operated to raise the bottom rail 6. The second drive shaft 22 is now rotated counter clockwise as indicated by the arrow B. Consequently, the toothed shaft 106 rotates in the same direction (counter clockwise). Because of the continuous engagement with the toothed shaft 106 the toothed nut 104 thereby is rotated along the threaded shaft 102 and returns to the predetermined catch position of FIG. 3A.

Figure 4C:
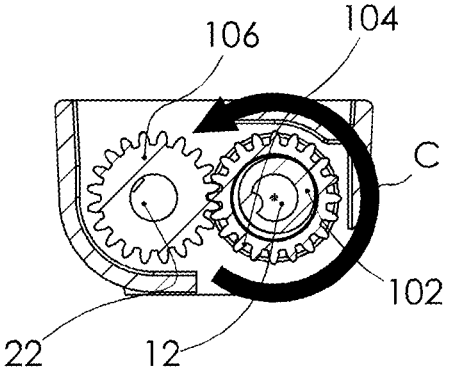

In FIG. 4C the first control means are operated to lower the middle rail 4. The first drive shaft 12 is rotated counter clockwise as indicated by the arrow C. Consequently, the threaded shaft 102 rotates in the same direction (counter clockwise). Because of the continuous engagement with the toothed shaft 106 the toothed nut 104 thereby is translated along the toothed shaft towards the predetermined catch position of FIG. 3A.

Figure 4D:
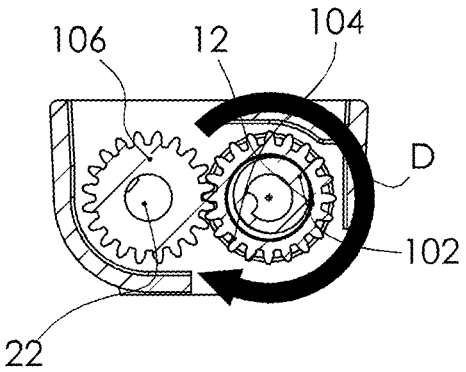

In FIG. 4D the first control means are operated to raise the middle rail 4. The first drive shaft 12 is rotated clockwise as indicated by the arrow D. Consequently, the threaded shaft 102 rotates in the same direction (clockwise). Because of the continuous engagement with the toothed shaft 106 the toothed nut 104 thereby is translated along the toothed shaft 106 out of the predetermined catch position of FIG. 3A.

In the first preferred embodiment the shaft rotation limiting system 100 is accommodated in a housing or cradle 110. The cradle has a bearing function for the shaft 102 and the shaft 106 and has an adaptive function with respect to mounting in the headrail.

The threaded shaft 102 and the toothed nut 104 are provided with cooperating first arresting means defining the predetermined catch position. At the side of the threaded shaft 102 a first stop or catch 108 is arranged to define the catch or stop position for the toothed nut 104. The toothed nut 104 is for this purpose provided with a first cam 107 for cooperation with the catch 108.

The toothed nut 104 takes up the catch position every time the middle rail 4 and the bottom rail 6 meet. In the first preferred embodiment the first drive shaft 12 and the second drive shaft 22 rotate in opposite directions (clockwise and counter clockwise or vice versa) for moving the middle rail 4 and the bottom rail 6 in the same height direction (up or down). The threaded shaft 102 engages the toothed nut 104 on the inner side for translation along the toothed shaft 106 to any actual position. The toothed shaft 106 engages the toothed nut 104 on the outer side for rotation around and consequently translation along the threaded shaft 106 to any actual position. The distance between the actual position and the catch position sets a maximum distance the middle rail 4 can travel towards the bottom rail 6 or the bottom rail 6 can travel towards the middle rail 4.

The shaft rotation limiting system 100 couples the first drive shaft 12 and the second drive shaft 22 and ensures a minimum distance between the middle rail 4 and the bottom rail 6 to prevent loss of tension in the lift cords.

FIG. 5 shows a schematic view of a second preferred embodiment of a screen 401 according to the invention. The second preferred embodiment is based on the first preferred embodiment shown in FIG. 1, wherein at least one additional collapsible screen material 409 is supported by the middle rail 404 and the head rail 402. When compared to FIG. 1 corresponding components are designated with corresponding reference numerals raised by 400.

The screen of FIG. 5 is also known as a Day Night System.

FIG. 6 shows a schematic view of a third preferred embodiment of a screen 601 according to the invention. FIG. 7 shows the screen of FIG. 601 with exploded parts. The screen 601 is a window covering, more specifically a top down, bottom up honey cell blind.

The screen 601 differs from the screen 1 shown in FIGS. 1 and 2 in that the control means are motorized. The first control means comprise a motor 611 instead of a chain or cord, a gear and a transmission. The second control means comprise a motor 621 instead of a chain or cord and a gear. In the preferred embodiment shown the motor is a by pull (de-) activated motor having a chain 614 respectively 624. One example of a suitable by pull (de-activated) motor is the motor described in the Dutch patent 2016447 of the same applicant. Alternatively a motor with an antenna for receiving RF signals from a remote control or a wall switch can be used.

The reference numerals of all other elements of the screen 601 are raised with the number 600 with respect to the reference numerals of the corresponding elements of the screen 1.

In the third preferred embodiment the screen 601 is provided with the first preferred embodiment of the shaft rotation limiting system 100 that continuously couples parallel oriented first and second drive shafts 612, 622.

The invention provides a shaft rotation limiting system for a screen with a head, middle and bottom rail that can move into and out of a catch position, wherein the distance between the middle rail and the bottom rail is at a minimum. Starting from the catch position all lowering operations require the bottom rail to be lowered first before the middle rail can be lowered and all pulling operations require the middle rail to be pulled up before the bottom rail can be pulled up.

The invention is of course not limited to the described and shown preferred embodiments. As an example the preferred embodiments comprise cord spools for (un)winding lift cords, but the invention extends to alternative embodiments comprising alternative winding elements for alternative lifting means, such as drums for lift tapes or lift bands, that are for instance used in pleated blinds.

Consequently the invention extends to any embodiment falling within the scope of protection as defined in the claims and as seen in the light of the foregoing description and accompanying drawings.

The invention claimed is:

1. A screen (1; 401; 601) comprising a headrail (2; 402; 602);

a bottom rail (6; 406; 606) movable with respect to the head rail;

a middle rail (4; 404; 604) arranged movably between the head rail and the bottom rail, at least one collapsible screen material (8; 408; 608) supported by the middle rail and the bottom rail;

a first control unit (10; 410; 610) comprising a first drive shaft (12), first control means (14, 16, 18; 414; 614) for rotating said first drive shaft, at least one first winding element (30, 32) rotatable with the first drive shaft for winding and unwinding first lift means (34) extending between the head rail and the middle rail;

a second control unit (20; 420; 620) comprising a second drive shaft (22), second control means (24, 26) for rotating said second drive shaft, at least one second winding element (32) rotatable with the second drive shaft for winding and unwinding second lift means (36) extending between the head rail and the bottom rail through the middle rail and the screen material;

and a shaft rotation limiting system (100) comprising a threaded shaft (102) arranged on and rotatable in unison with one of the first and the second drive shafts, a coupling element (104) threaded on said threaded shaft, wherein the coupling element is associated with and rotatable in unison with the other drive shaft, characterized in that the shaft rotation limiting system (100) further comprises a toothed shaft (106) arranged on and rotatable in unison with the other drive shaft and in that the coupling element is a toothed nut (104) that is in continuous engagement with the toothed shaft (106).

2. The screen according to claim 1, wherein the toothed nut (104) takes up a predetermined catch position on the threaded shaft (102) and wherein the toothed nut moves out of the catch position upon rotation of either the first shaft (12) or the second shaft (22) and wherein the toothed nut moves towards the catch position upon rotation of the other shaft.

3. The screen according to claim 1, wherein the first drive shaft (12) and the second drive shaft (22) rotate in opposite directions for moving the middle rail (4) and the bottom rail (6) in the same direction.

4. The screen according to claim 1, wherein the toothed nut (104) is translatable along the toothed shaft (106) upon rotation of the threaded shaft (102).

5. The screen according to claim 1, wherein the toothed nut (104) is rotatable along the threaded shaft (102) upon rotation of the toothed shaft (106).

6. The screen according to claim 1, wherein the threaded shaft (102) and the toothed nut (104) are provided with cooperating first arresting means (107, 108) defining the predetermined catch position.

7. The screen according to claim 1, comprising a housing (110), wherein the shaft rotation limiting system (100) is accommodated.

8. The screen according to claim 1, wherein at least one additional collapsible screen material (409) is supported by the middle rail (404) and the head rail (402).

9. The screen according to claim 1, wherein the first control means (610) and/or the second control means (620) are motorized.

10. The screen according to claim 1, wherein the screen is a window covering.

* * * * *